US006813556B2

(12) United States Patent
Watanabe

(10) Patent No.: US 6,813,556 B2
(45) Date of Patent: Nov. 2, 2004

(54) TRAFFIC INFORMATION NOTIFICATION SYSTEM

(75) Inventor: Yoshinori Watanabe, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/201,220

(22) Filed: Jul. 24, 2002

(65) Prior Publication Data

US 2003/0033077 A1 Feb. 13, 2003

(30) Foreign Application Priority Data

Aug. 7, 2001 (JP) ..... 2001-239639

(51) Int. Cl.[7] ..... G06G 7/76; G08G 1/00

(52) U.S. Cl. ..... 701/117; 701/201; 340/905; 455/414.3

(58) Field of Search ..... 701/117, 118, 701/119, 201, 208, 209, 210, 211; 340/990, 995.1, 995.13, 995.11, 995.19, 995.23, 995.28, 901, 905, 988; 342/357.13, 357.09, 357.1; 455/414.2, 414.3, 456.3

(56) References Cited

U.S. PATENT DOCUMENTS 6,178,374 B1 * 1/2001 Mohlenkamp et al. ..... 701/117
6,178,378 B1 * 1/2001 Leibold ..... 701/202
6,295,503 B1 * 9/2001 Inoue et al. ..... 701/209
6,317,686 B1 * 11/2001 Ran ..... 701/210
6,480,783 B1 * 11/2002 Myr ..... 701/117
6,622,087 B2 * 9/2003 Anderson ..... 701/209
6,707,421 B1 * 3/2004 Drury et al. ..... 342/357.1
2002/0147541 A1 * 10/2002 Trovato ..... 701/117

FOREIGN PATENT DOCUMENTS

| | | |
|---|---|---|
| JP | A-6-274795 | 9/1994 |
| JP | A-6-290393 | 10/1994 |
| JP | A-9-257504 | 10/1997 |
| JP | A-2000-39332 | 2/2000 |

* cited by examiner

*Primary Examiner*—Tan Q. Nguyen
(74) *Attorney, Agent, or Firm*—Posz & Bethards, PLC

(57) ABSTRACT

In a traffic information notifying system, a management center is connected through communication networks information terminal devices owned by a traveler and information centers that provide various traffic information. The management center registers a travel plan input from the terminal devices, and monitors the traffic information of the information centers to check for any traffic flow disruption on the registered travel route. If there is any disruption, the management center notifies it to the traveler through the terminal devices.

13 Claims, 2 Drawing Sheets

TRAFFIC INFORMATION NOTIFICATION SYSTEM

CROSS REFERENCE TO RELATED APPLICATION

This application is based on and incorporates herein by reference Japanese Patent Application No. 2001-239639 filed on Aug. 7, 2001.

FIELD OF THE INVENTION

The present invention relates to a traffic information notification system that notifies information about traffic flow disruption or impediment to system users such as travelers.

BACKGROUND OF THE INVENTION

Vehicle information and communication systems (VICS) provide various information such as road restrictions, traffic congestion and the like. Public or private transportation companies also provide various information about transportation services, delay of transportation services and the like, respectively. Travelers, who plan to move from one location (departure point) to another (destination point) by using public transportation, are thus capable of acquiring the traffic information about the planned route of travel and, as the case may be, changing the travel route or the transportation. The traveler must however usually acquire those information in advance of starting the planned travel to avoid possible traffic flow disruption.

SUMMARY OF THE INVENTION

It is therefore an object of the present invention to provide a traffic information notifying system that notifies to system users of traffic flow disruption or impediment occurring on the route of travel from the departure point and the destination point.

According to the present invention, a traffic information notifying system is constructed with a terminal device owned by a user, an information center for providing traffic information and a management center operatively connected to the terminal device and the information center for communication therewith. The management center registers therein a travel plan input from the terminal device. The travel plan includes route information about a travel route to a destination point and time information about time of passing and arrival on the travel route. The management center monitors a traffic flow disruption which is influential on the travel plan based on the registered travel plan and the traffic information, and notifies the traffic flow disruption to the user through the terminal device.

Preferably, the management center further calculates at least one of alternative departure time and alternative travel route recommended to avoid the traffic flow disruption based on the traffic information when the traffic flow disruption occurs, and notifies at least one of the alternative departure time and the alternative travel route in addition to the traffic flow disruption.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT (First Embodiment)

Figure 1:
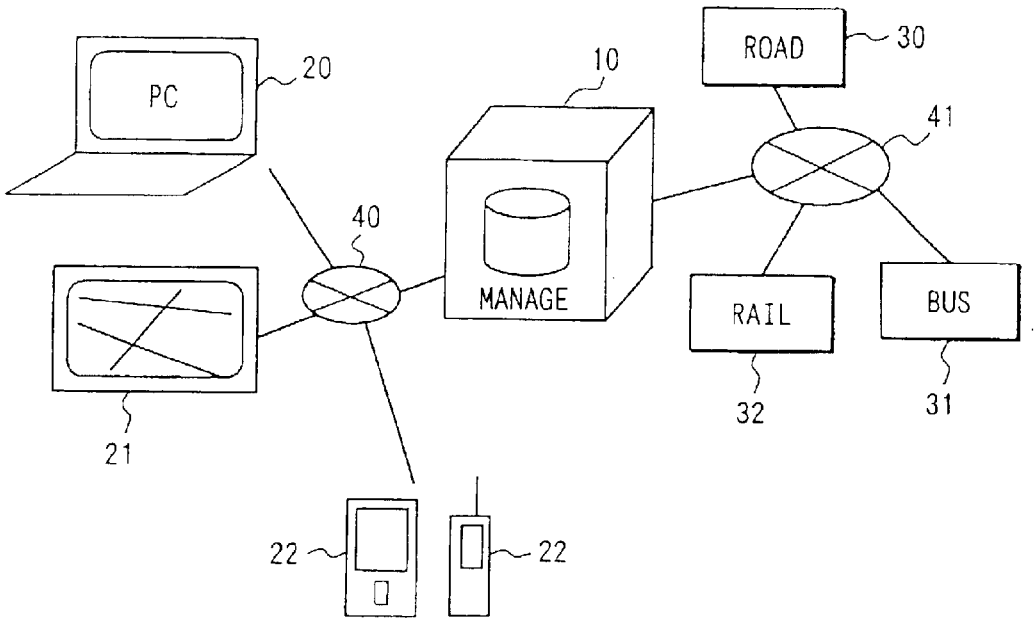
FIG. 1 is a schematic diagram showing a traffic information notifying system according to the first embodiment of the present invention.

Referring first to FIG. 1, a traffic information notification system comprises-a management center 10 that centrally manages traffic information and a plurality of terminal information devices 20–22 owned by system users, that is, travelers in this embodiment. The management center 10 and the terminal devices 20–22 are connected to a communication network 40 to be able to communicate one another. The network 40 may be the Internet or a mobile communication system.

The management center 10 includes a server computer. The terminal devices 20–22 include personal computers 20, navigation devices 21, personal data assistant devices (PDA) 22, cellular phones 22, electronic notes, wrist watches or the like. These terminal devices 20–22 have communication functions, and allow the system users to input and upload their travel plans (schedules) for registration in the management center 10. Each travel plan may be defined with a destination point, passing points, arrival time and the like.

The management center 10 is connected to a plurality of traffic information centers 30–32 through a communication network 41. The information centers 30–32 include road information centers 30 that provide information about traffic congestion or stop of roads, bus information centers 31 that provide information about bus services, and railroad information centers 32 that provide information about train services. The road information center 30 may use a vehicle information and communication system (VICS). The network 41 may be the Internet or a mobile communication system. The management center 10 thus collects traffic information from the information centers 30–32. The information centers 30–32 update traffic information from time to time, so that the management center 10 may always have the latest traffic information including traffic accidents which disrupt traffic flow.

Thus, when the management center 10 receives and register a travel plan input from the terminal device 20–22, the management center 10 checks traffic information provided from the information centers 30–32 about the registered travel plan. The management center 10 then provides the latest traffic information including occurrence of traffic flow disruption in the registered route of travel to the terminal devices 20–22. The management center 10 usually notifies the traffic information to the terminal device 20–22, which transmitted the travel plan to the management center 10. However, it is preferred to notify the same traffic information to other terminal devices as well which the user has registered, so that the user may also acquire the traffic information from another terminal device different from the one 20–22 which was used to register the travel plan.

Figure 2A:
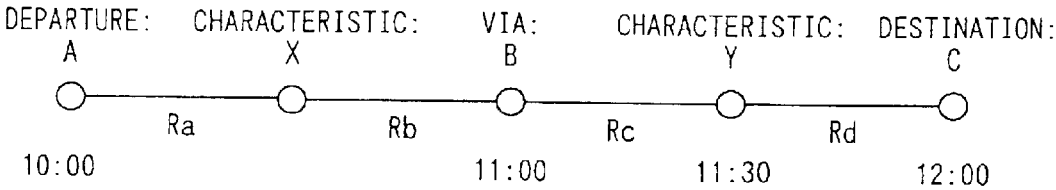
FIGS. 2A and 2B are diagrams showing travel plans.
Figure 2B:
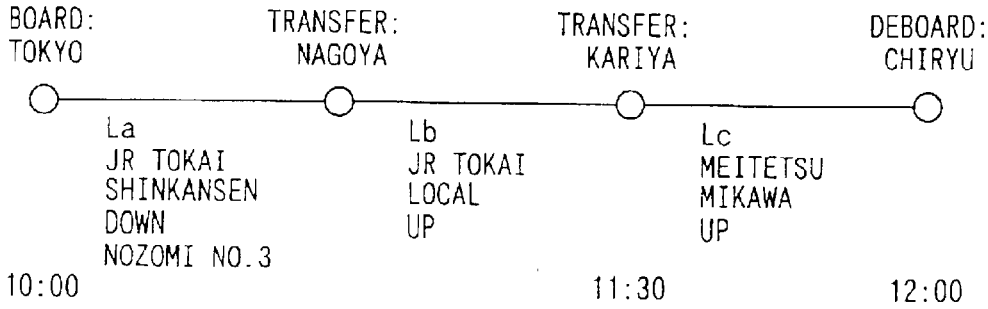

The travel plan that is registered in the management center 10 from the terminal devices 20–22 is defined specifically in a manner shown in FIGS. 2A and 2B. The travel plan requires at least a departure point, destination point, route (via or passing points) to the destination point, and arrival time at each point. Therefore, the travel plan includes route information about a travel route from a departure point to a destination and time information about time of passing via points between the departure point and the destination point.

FIG. 2A shows a case of travel by cars, bicycles or on foot. In this case, the route information of the travel plan includes (1) location information such as a departure point, destination point, via points, characteristic points in a travel route, and (2) road identification information such as a road name (e.g., Tomei-expressway), road type (e.g., inter-city expressway), road number (e.g., national road No. 1), specific ID number. The location point may be defined with a location coordinate, location name, location phone number and location address. The characteristic points may be the departure point, destination point, via points, point at which road type or name changes, curving point, fixed distance point, or the like.

In the travel plan shown in FIG. 2A, the travel takes a road Ra from a departure point A to a characteristic point X, a road Rb from the characteristic point X to a via point B, a road Rc from the via point B to a characteristic point Y, and finally a road Rd from the characteristic point Y to a destination point C. Further, the travel starts at 10:00 a.m. from departure point A, passes the via point B at 11:00 a.m., and ends at the destination point C at 12:00 a.m. (0:00 p.m.).

FIG. 2B shows a case of travel by public transportation services. In this case, the travel plan includes, as the route or location information, a boarding station, transfer stations, de-boarding station, company names of transportation services, and transportation line names and the like. The travel plan also includes, as the time information, a boarding time, transfer time, de-boarding time. In the case of public transportation, a train name or type, train number (e.g., Shinkansen Nozomi No. 1) and the like may alternatively be used as the time information in place of various time data, because those train information correspond to time data.

In the travel plan shown in FIG. 2B, the travel takes a rail line La (JR Tokai, Shinkansen, downward-bound, Nozomi No. 3) from Tokyo to Nagoya, line Lb (JRTokai, local train, upward-bound) from Nagoya to Kariya, and line Lc (Meitetsu, Mikawa line, upward-bound) from Kariya to Chiryu). Further, the travel starts at 10:00 a.m. from Tokyo, passes Kariya at 11:30 a.m., ends at Chiryu at 12:00 a.m. (0:00 p.m.).

If a traveler uses both a car and a public transportation, the travel plan is defined with a combination of the above information, for instance, a combination of travel plans shown in FIGS. 2A and 2B.

The traffic information, particularly traffic flow disruption, which the management center 10 monitors, includes road block (period and cause of blocking), traffic regulations (speed regulation, lane regulation, chain regulation), congestion (length and degree of congestion, allowable speed), expected congestion, weather forecast (rain, snow, freezing, wind, fog) and the like, in the case of travel by a car. The traffic flow disruption information includes, in the case of travel by public transportation, unavailable service (area and cause), delay (delay time, expected recovery time and cause), occupancy (reserved seat and normal seat) and the like.

The management center 10 not only notifies the above traffic information regarding the traffic flow disruption, but also provides additional information regarding method of avoiding such a traffic flow disruption by calculating time required to eliminate the disruption or determining an another route. If the traffic flow disruption is caused by traffic congestion or transportation service delay, it is generally possible to arrive at the destination point by the scheduled time if the traveler leaves the departure point earlier than originally planned. Therefore, the management center 10 calculates recommended time of leaving based on the conditions of the traffic congestion and the transportation service delay. Further, in the case of road block or unavailability of transportation service, the management center 10 determines and notifies a recommended alternative route to complete a travel by avoiding such traffic flow disruptions occurring on the initially planned travel route.

Figure 3:
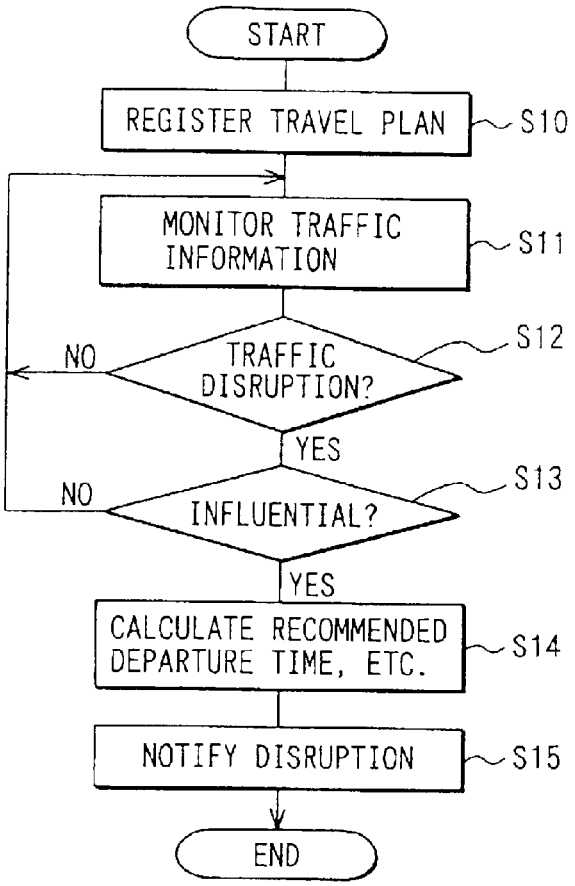
FIG. 3 is a flow diagram showing traffic flow disruption notifying processing executed in the first embodiment.

For the above operation, the management center 10 is programmed to execute processing shown in FIG. 3.

The management center 10 first registers at step S10 the travel plan, that a traveler has transmitted from the terminal device 20–22. The management center 10 also registers the identification of the terminal device 10 from which the travel plan has been input and, if requested, an additional terminal device to which the traffic information should be notified.

The management center 10 monitors at step S11 traffic information provided from the information centers 30–31 and related to the registered travel route, and checks at step S12 whether any traffic information is indicative of occurrence of traffic flow disruption on the registered travel route. If there is a traffic flow disruption (YES at step S12), the management center 10 further checks at step S13 whether the disruption is influential on the registered travel plan. If there is no disruption (NO at step S12) or the disruption is not so influential (NO at step S13), the management center 10 repeats steps S11 to S13.

However, if the disruption is influential (YES at step S13), the management center 10 calculates at step S14 a departure time and/or an alternative route recommended to avoid the disruption. The management center 10 then notifies the traffic information including if any the traffic flow disruption and the recommended departure time and/or alternative route. The terminal device 20–22 receives and displays those traffic information so that the traveler may take any appropriate action.

According to the present invention, once the travel plan is registered from the traveler, traffic information including traffic flow disruption influential on the planned travel are automatically notified to the traveler. As a result, the traveler is enabled to change the travel plan with ease not only before but also after the departure for a destination.

(Second Embodiment)

Figure 4:
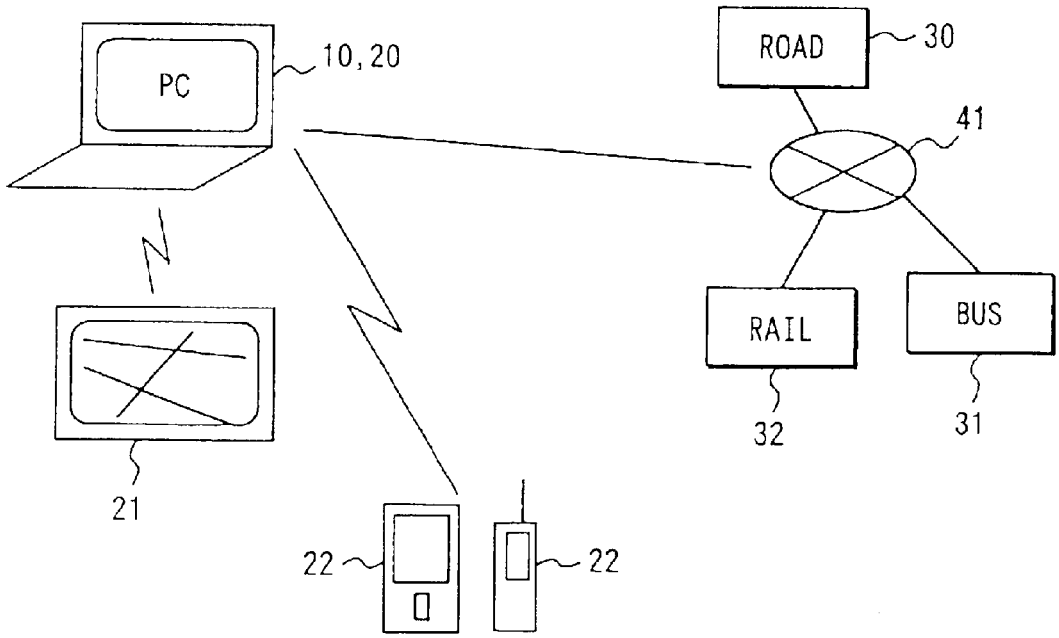
FIG. 4 is a schematic diagram showing a traffic information notifying system according to the second embodiment of the present invention.

In this embodiment, as shown in FIG. 4, one of the terminal devices 20–22 (personal computer 20) is used to function as the management center 10 as well as opposed to the first embodiment in which the management center 10 is designed to manage a plurality of travel plans centrally. The terminal device 20 is connected to the information centers 30–32 through the network 41 to operate as the management center 10 as well. The terminal device 20 is of course capable of communicating with the terminal devices 21 and 22. Those terminal devices 20–22 are in possession of the same user.

In this embodiment, a travel plan is registered in the terminal device 20 directly or through other terminal devices 21 and 22. The terminal device 20 monitors traffic flow disruption based on the registered travel plan and the traffic information provided from the information centers 30–32. If any disruption occurs, the terminal device 20 and/or other terminal devices 21 and 22 notify the disruption in a manner similar to the first embodiment.

The above embodiments may be modified in many other ways without departing from the spirit of the invention. For instance, in addition to the information centers 30–32 which provide ground traffic information, additional information centers such as a sea traffic information which provides traffic information of sea bus, river bus or ferry may also be provided.

What is claimed is:

1. A traffic information notifying system comprising:

a first terminal device and a second terminal device both owned by a user;

an information center for providing traffic information; and a management center for operatively communicating with the first terminal device, the second terminal device and the information center, wherein the management center includes:

means for registering therein the first terminal device, a travel plan input from the first terminal device, and the second terminal device if so instructed by the first terminal device upon registering the travel plan, the travel plan including route information about a travel route to a destination point and time information about time of passing and arrival on the travel route;

means for monitoring a traffic flow disruption which is influential on the travel plan based on the registered travel plan and the traffic information; and means for notifying the traffic flow disruption to the first terminal device and to the second terminal device when the registering means has registered the second terminal device.

2. The notifying system as in claim 1, wherein the first terminal device is constructed to also operate as the management center.

3. The notifying system as in claim 1, wherein the management center further includes means for calculating at least one of alternative departure time and alternative travel route recommended to avoid the traffic flow disruption based on the traffic information when the traffic flow disruption occurs, and the notifying means notifies at least one of the alternative departure time and the alternative travel route in addition to the traffic flow disruption.

4. The notifying system as in any one of claims 1 to 3, wherein the terminal device is a portable communication device which the user can carry.

5. A traffic information notifying program for a computer connected to a first terminal device and a second terminal device both owned by a user and an information center, the traffic information notifying program providing traffic information to enable the computer to perform the following:

registering the first terminal device and, if instructed by the first terminal device, the second terminal device, as well as a travel plan input from the first terminal device, the travel plan including route information about a travel route to a destination point and time information about time of passing and arrival on the travel route;

monitoring a traffic flow disruption which is influential on the travel plan based on the registered travel plan and the traffic information; and notifying the traffic flow disruption to the first terminal device and to the second terminal device if the second terminal device is registered.

6. A traffic information notifying system comprising:

a terminal device owned by a user;

an information center for providing traffic information regarding public transportation services; and a management center operatively connected to the terminal device and the information center for communication therewith, wherein the management center includes:

means for registering therein a travel plan input from the terminal device, the travel plan including route information about a travel route to a destination point, public transportation to be used, and time information about time of passing and arrival on the travel route;

means for monitoring a traffic flow disruption that is available at a time of the travel plan input and that is influential on the travel plan based on the registered travel plan and the traffic information; and means for notifying the traffic flow disruption to the terminal device in response to the travel plan input from the terminal device.

7. The traffic information notifying system as in claim 6, wherein the traffic information includes road information, the route information specifies a road to be used, and the traffic flow disruption includes a disruption in the public transportation services.

8. The traffic information notifying system as in claim 6, wherein the terminal device is constructed to operate as the management center as well.

9. The traffic information notifying system as in any one of claims 6 to 8, wherein the management center further includes means for calculating at least one of alternative departure time and alternative travel route recommended to avoid the traffic flow disruption based on the traffic information when the traffic flow disruption occurs, and the notifying means notifies at least one of the alternative departure time and the alternative travel route in addition to the traffic flow disruption.

10. The traffic information notifying system as in any one of claims 6 to 8, wherein the notifying means notifies the traffic flow disruption to another terminal device that the user designated when registering the travel plan.

11. The notifying system as in any one of claims 6 to 8, wherein the terminal device is a portable communication device that the user can carry.

12. A traffic information notifying program for a computer connected to a terminal device owned by a user and an information center, the traffic information notifying program providing traffic information to enable the computer to perform the following:

registering a travel plan input from the terminal device, the travel plan including route information about a travel route to a destination point, public transportation services to be used, and time information about time of passing and arrival on the travel route;

monitoring a traffic flow disruption which is available at a time of the travel plan input and influential on the travel plan based on the registered travel plan and the traffic information; and notifying the traffic flow disruption to the terminal device in response to the travel plan input from the terminal device.

13. The traffic information notifying program of claim 12, wherein the traffic information includes road information, the route information specifies a road to be used, and the traffic flow disruption includes a disruption in the public transportation services.

* * * * *